US006722072B1

(12) United States Patent
McCormick

(10) Patent No.: US 6,722,072 B1
(45) Date of Patent: Apr. 20, 2004

(54) TRIGGER GROUP MODULE FOR FIREARMS AND METHOD FOR INSTALLING A TRIGGER GROUP IN A FIREARM

(76) Inventor: Michael L. McCormick, 1715 W. FM 1626, Suite 105, Manchaca, TX (US) 78652

( * ) Notice: Subject to any disclaimer, the term of this patent is extended or adjusted under 35 U.S.C. 154(b) by 20 days.

(21) Appl. No.: 10/152,557

(22) Filed: May 21, 2002

(51) Int. Cl.[7] ..... F41A 21/00
(52) U.S. Cl. ..... 42/75.03; 42/69.03
(58) Field of Search ..... 42/75.03, 41, 42.03, 42/42.02

(56) References Cited

U.S. PATENT DOCUMENTS

| | | | | | |
|---|---|---|---|---|---|
| 3,323,246 | A | * | 6/1967 | Loffler | 42/75.01 |
| 3,863,375 | A | * | 2/1975 | Browning | 42/69.01 |
| 3,924,512 | A | | 12/1975 | Fagg | 89/128 |
| 4,056,038 | A | | 11/1977 | Rath | 89/128 |
| 4,151,670 | A | | 5/1979 | Rath | 42/70 E |
| 4,662,098 | A | | 5/1987 | Timari | 42/69.01 |
| 4,872,391 | A | * | 10/1989 | Stoner | 89/155 |
| 5,052,141 | A | * | 10/1991 | Sammons | 42/69.01 |
| 5,454,182 | A | | 10/1995 | Lewis et al. | 42/51 |
| 5,487,233 | A | * | 1/1996 | Jewell, Arnold W. | 42/69.01 |
| 5,501,134 | A | | 3/1996 | Milazzo et al. | 89/139 |
| 5,614,691 | A | * | 3/1997 | Taylor | 89/128 |
| 5,659,992 | A | * | 8/1997 | Mistretta | 42/23 |
| 5,680,722 | A | * | 10/1997 | French et al. | 42/69.03 |
| 5,697,178 | A | * | 12/1997 | Haskell | 42/70.04 |
| 5,881,485 | A | | 3/1999 | Milazzo | 42/70.08 |
| 6,131,324 | A | | 10/2000 | Jewell | 42/69.03 |
| 6,293,040 | B1 | * | 9/2001 | Luth | 42/75.01 |
| 6,487,806 | B2 | * | 12/2002 | Murello et al. | 42/75.03 |

* cited by examiner

*Primary Examiner*—Michael J. Carone
*Assistant Examiner*—Denise J. Buckley
(74) *Attorney, Agent, or Firm*—Russell D. Culbertson; Shaffer & Culbertson, L.L.P.

(57) ABSTRACT

A module housing is adapted to be inserted into an operating position in the trigger group receiving area of a firearm. The module housing includes at least one pin receiver defined by two openings formed in the module housing, one on each lateral side of the housing. A module or temporary pin is received in the pin receiver and at least one trigger group component is mounted or supported for rotation on the module pin. The pin receiver is located on the module housing so as to align with a pin receptacle of the firearm when the module housing is in the operating position. By locating the pin receiver in the module housing so as to align with a corresponding pin receptacle of the firearm when the module housing is in the operating position, the trigger group module and the trigger group components housed in the module housing may be readily supported by the OEM pin receptacle. The trigger group module, pre-assembled with one or more trigger group components, may be inserted to the operating position and then held in place using the OEM pin receptacle.

11 Claims, 5 Drawing Sheets

TRIGGER GROUP MODULE FOR FIREARMS AND METHOD FOR INSTALLING A TRIGGER GROUP IN A FIREARM

TECHNICAL FIELD OF THE INVENTION

The invention relates to firing mechanisms for firearms. More particularly, the invention relates to a trigger group module pre-assembled with one or more trigger group components and adapted to be received in the frame of the firearm. The invention also relates to a method of installing trigger group components in a firearm.

BACKGROUND OF THE INVENTION

Firearm firing mechanisms generally include a number of components that cooperate to hold a spring-loaded hammer in a cocked position and then selectively release the hammer. The firearm is fired or discharged when the force of the released hammer is applied, directly or through an intermediate device, to an ammunition cartridge loaded in the firearm. The components for holding the hammer in a cocked position and then releasing the hammer as desired may be referred to as a trigger group. In addition to the hammer itself, a trigger group generally includes a trigger component having a finger lever or trigger that a user pulls to release the hammer, and further includes a sear which may be a separate component or integrally formed with the trigger component. Some trigger groups also include other components such as a disconnector for example. The disconnector is used in semi-automatic firearms to catch the hammer as it rebounds after firing and to hold the hammer in a cocked position until the shooter can release the trigger and thereby reset the trigger group to the "ready to fire position." The disconnector is required for this function because semi-automatic firearms usually cycle so quickly that it is physically impossible for the shooter to release the trigger quickly enough after a discharge to allow the sear to recapture the hammer in the cocked position.

Both the hammer component and trigger component are commonly mounted for rotation in the firearm. The hammer is mounted on a hammer pin to facilitate the desired rotation, while the trigger component is mounted on a trigger pin. Each pin is retained in a respective pin receptacle formed in the firearm. Each such pin receptacle is defined by a first opening on one side of the firearm and a second opening on the opposite side of the firearm. A hammer spring is included in the trigger group to, among other things, bias the hammer forward to a striking position. The trigger component is also spring biased to provide resistance against pulling the trigger and to return the trigger after it has been pulled.

It may be desirable to modify or replace trigger group components in a firearm. This is particularly true for firearms used in competition. Such competition firearms may be fitted with special trigger group components designed to improve firearm performance or operational characteristics, or to suit the preferences of the particular user. Also, different competitions or firearm applications may require different trigger group characteristics. However, due to the relatively small components in the trigger group, the spring loading of components, the close tolerances between components, and the small area in the firearm allotted for trigger group components, a trigger group may commonly be installed only by a skilled gunsmith using specialized tools in order to ensure safe, proper, and reliable trigger group finctioning. Due to the difficulty in changing out trigger group components, it is common for many competition shooters to have several different complete firearms each with a different trigger group setup for a particular competition or portion of a competition. Maintaining several complete firearms greatly increases the cost of competitive shooting.

SUMMARY OF THE INVENTION

The present invention provides a trigger group module that is pre-assembled with the trigger group components and adapted to be mounted in a trigger group receiving area in place of the original equipment manufacturer (OEM) trigger group. The invention includes a special module housing and also includes the special housing pre-assembled with one or more trigger group components to form the self-contained trigger group module. The invention further includes methods for mounting or installing a trigger group in a firearm.

A module housing according to the invention is adapted to be inserted into an operating position in the trigger group receiving area of a firearm. The module housing includes at least one pin receiver defined by two openings formed in the module housing, one on each lateral side of the housing. In one form of the invention a module or temporary pin is received in the pin receiver and at least one trigger group component is mounted or supported for rotation on the module pin. In this form of the invention, the pin receiver is located on the module housing so as to align with a pin receptacle of the firearm when the module housing is in the operating position. That is, the two openings defining the pin receiver on the module housing are adapted to align with the openings on the firearm that define a pin receptacle for the firearm.

By locating the pin receiver in the module housing so as to align with a corresponding pin receptacle of the firearm when the module housing is in the operating position, the trigger group module and the trigger group components housed in the module housing may be readily supported by the OEM pin receptacle. The trigger group module, pre-assembled with one or more trigger group components, may be inserted to the operating position and then a permanent pin may be inserted or extended through the OEM pin receptacle and aligned trigger group component to support the trigger group component in the desired functional position in the firearm. The module housing and temporary pin hold the trigger group component in place while the module housing is being placed in the firearm. Once the module housing is inserted to the operating position, the module and associated trigger group components may be secured in place with the OEM pin receptacles and cooperating permanent pins. No modification to the frame of the firearm is required and no special skill or tools are required to install the self-contained, pre-assembled trigger group module.

One preferred form of the invention is adapted to be used with a firearm that includes a hammer pin receptacle and a trigger pin receptacle. The trigger group module for this firearm includes a first pin receiver and a second pin receiver. The first pin receiver aligns with the hammer pin receptacle of the firearm when the housing is in the operating position and the second pin receiver aligns with the trigger pin receptacle when the housing is in the operating position. To install this trigger group module, the original trigger group components are removed from the firearm together with any interfering components such as safety mechanisms for example, and then the pre-assembled trigger group module is placed in the operating position in the firearm. Once in the operating position, the hammer and trigger component may be supported for rotation from the openings defining the hammer pin receptacle and trigger pin receptacle, respectively. This support also holds the entire module in place in the firearm.

In one preferred form of the invention, each module pin comprises a temporary pin that is temporarily supported in the respective pin receiver of the module housing. These temporary pins may be held in place with a suitable retainer which may comprise simply a membrane or adhesive tape adhered to the outer surface of the housing so as to cover the pin receiver openings. In this temporary pin arrangement, the module may be installed by aligning the pin receivers on the housing with the firearm pin receptacles and then inserting a permanent pin into each pin receptacle. Inserting a permanent pin into one of the pin receptacle openings pierces or displaces the membranes holding the temporary pin in place and displaces the temporary pin through the opposite side of the housing and pin receptacle.

One preferred form of the invention includes a module housing in which one or more housing pin receiver openings align with one or more OEM pin receptacle openings, but the module includes permanent pins rather than temporary pins. In this embodiment of the invention, the pins included in the trigger group module are not displaced by permanent pins inserted through the OEM pin receptacle openings. However, caps, screws, pins, or other elements may be inserted into the OEM pin receptacle openings to cooperate with a trigger group module pin to retain the trigger group module in the operating position. For example, the module pins may be hollow and adapted to receive pins inserted through the OEM pin receptacle openings to retain the module and module components in the operating position.

In yet other forms of the invention, the module housing may include no pin receiver openings located to align with OEM pin receptacle openings when the trigger group module is in the operating position in the firearm frame. Rather, the trigger group component geometry may be completely changed from the OEM trigger group geometry. In these forms of the invention, the OEM pin receptacle openings may still be used to receive screws, pins, or other devices to secure the trigger group module in the operating position in the firearm frame.

A module housing according to the invention may also include a trigger component control feature that defines or sets either the forward most or rearward most position of the trigger component. Two different trigger component control features may be used to set both the forward most and rearward most position of the trigger component. The trigger component control feature setting the rearward most position of the trigger component provides overtravel control to minimize the amount of trigger movement possible after the hammer release point. The trigger component control feature setting the forward most position of the trigger component provides take-up control which minimizes the movement of the trigger required before reaching the hammer release point. A major advantage of the present invention is that by incorporating the overtravel and take-up features in the module housing, trigger overtravel and take-up may be modified without having to modify the frame of the firearm itself.

These and other features and advantages of the invention will be apparent from the following description of the preferred embodiments, considered along with the accompanying drawings.

DESCRIPTION OF PREFERRED EMBODIMENTS

Figure 1A:
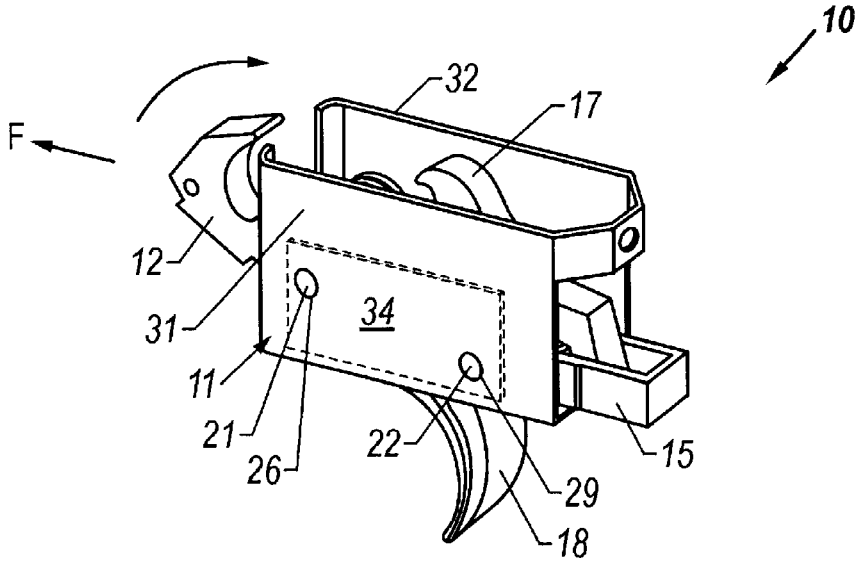
FIG. 1A is a view in perspective of a trigger group module embodying the principles of the invention.

A trigger group module 10 and module housing 11 embodying the principles of the invention may be described with reference to FIGS. 1A and 1B through FIG. 3. A method embodying the principles of the invention for installing a trigger group may be described with reference to FIGS. 4 through 8.

In the following description and claims, certain elements may be described as right side elements while others may be described as left side elements. The terms right side and left side are used only for purposes of convenience to indicate that a particular element is located on one lateral side of the respective structure while another element is located on the opposite lateral side of the structure. Of course, whether an element is truly located on a right side or left side depends upon the perspective of the viewer. For purposes of consistency, the right side elements described below will be those elements located on the right side of trigger group module 10 as viewed from the front of the module with the trigger extending downwardly, while the left side elements will be those elements on the left side as viewed from the front of the module. The direction from the rear to the front of the module will be indicated by the arrow F in each figure showing the module.

Referring first to FIGS. 1A and 1B through FIG. 3, trigger group module 10 includes module housing or housing 11 for containing one or more trigger group components. The trigger group components shown for purposes of example are shown best in FIGS. 2 and 3 and include a hammer 12, hammer spring 14, a trigger component 15 having a trigger or finger lever 18, a trigger spring 16, and a disconnector 17. It will be appreciated by those skilled in the art that disconnector 17 is associated with a disconnector spring, however, this element is not necessary or helpful in describing the invention and is thus omitted from the drawings. The illustrated trigger group components are held in place in the module housing with temporary pins and specifically a first temporary pin 21 for hammer 12 and a second temporary pin 22 for trigger component 15. First temporary pin 21 is received through a pin opening 23 of the hammer while second temporary pin 22 is received through a pin opening 24 of trigger component 15 and a pin opening (not shown) of disconnector 17.

Housing 11 includes a first pin receiver for receiving first temporary pin 21 and supporting the first temporary pin by its ends. This first pin receiver is made up of a first right side receiver opening 26 on a right lateral side or first side wall 31 of housing 11 and a first left side receiver opening 27 on the opposite lateral side or second side wall 32 of the housing. Similarly, housing 11 includes a second pin receiver for receiving second temporary pin 22 and supporting the second temporary pin by its ends. This second pin receiver is made up of a second right side receiver opening 29 and a second left side receiver opening 30.

Figure 1B:
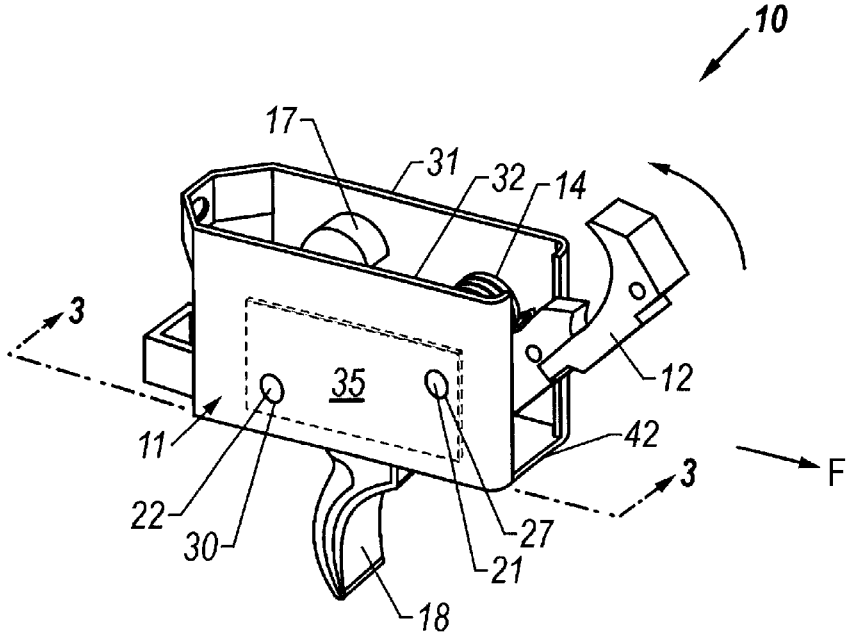
FIG. 1B is a view of the trigger group module shown in FIG. 1A from an opposite perspective to that shown in FIG. 1A.
Figure 2:
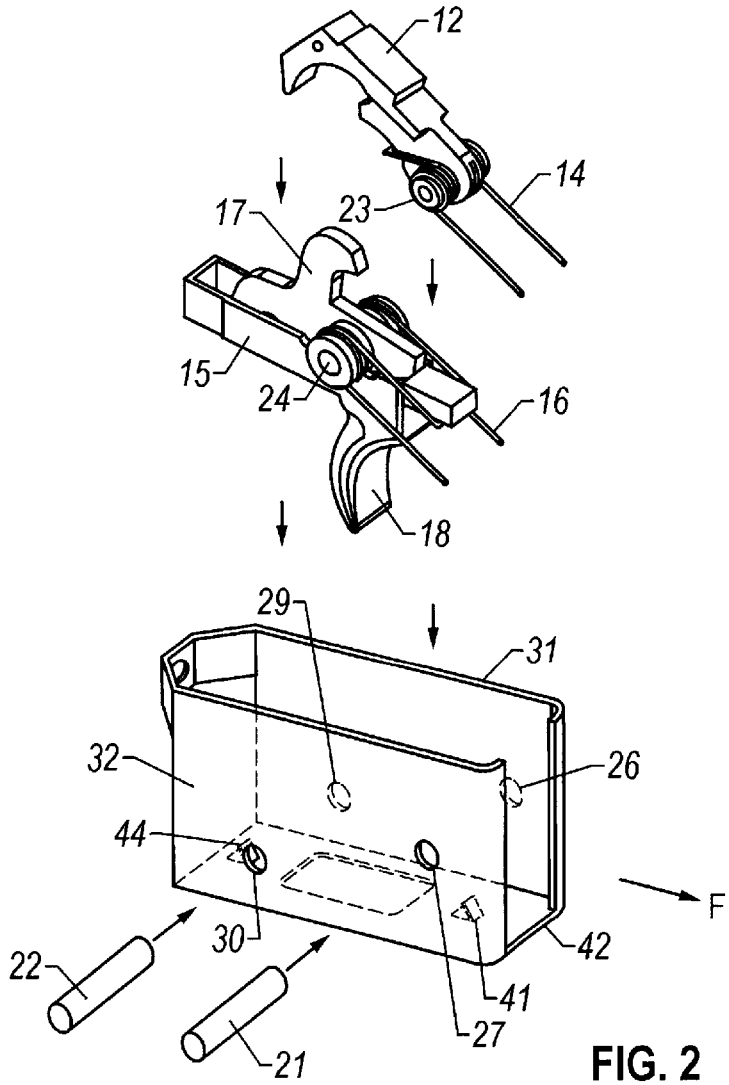
FIG. 2 is an exploded view in perspective of the trigger group module shown in FIGS. 1A and 1B.

As shown best in FIGS. 1A and 1B, the illustrated form of trigger group module 10 includes a temporary pin retainer for each temporary pin 21 and 22 included in the module. The temporary pin retainers in the illustrated form of the invention comprise pieces of tape or other thin material or membrane 34 and 35 adhered to the lateral sides 31 and 32, respectively. The membrane material is shown in phantom lines in the figures and is positioned on the lateral sides 31 and 32 of housing 11 so that the material covers or partially covers the respective side opening of the respective pin receiver. Membrane 34 may be referred to as a right side membrane positioned over the right side openings 26 and 29, while membrane 35 may be referred to as a left side membrane positioned over the left side receiver openings 27 and 30. Although a single membrane is shown covering both receiver openings on a side of housing 11, it will be appreciated that separate membranes may be used for each receiver opening, a first right side membrane for the first right side receiver opening 26, a first left side membrane for the first left side receiver opening 27, and so forth.

Those familiar with different types of firearms will recognize that the trigger group components shown for purposes of example in the embodiment of the invention shown in FIGS. 1A and 1B through FIG. 3 are the components used in the firing mechanism for the COLT model AR-15 rifle. However, these trigger group components are shown only for purposes of example and there are many other types and arrangements of trigger group components that may be included in a trigger group module embodying the principles of the present invention. The invention is in no way limited to the trigger group arrangement for an AR-15 rifle or the trigger group components shown in the figures. In particular, some trigger components are designed to slide along a track rather than pivot on a pin. Trigger groups having a sliding trigger component may include only a pin for the hammer.

Figure 3:
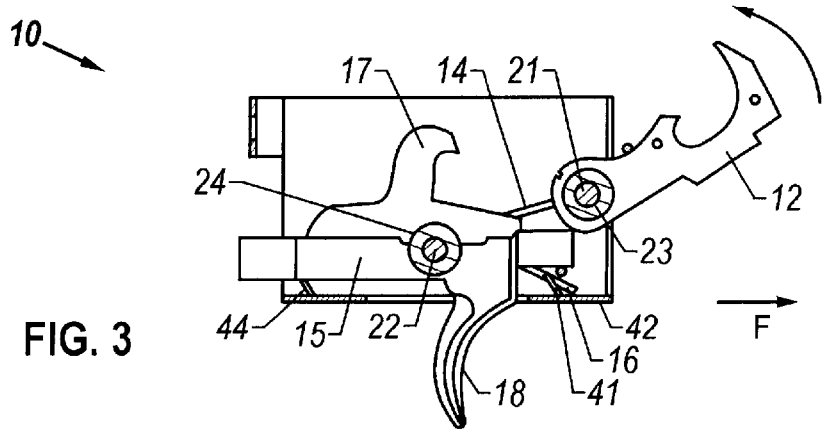
FIG. 3 is a view in section taken a long line 3—3 in FIG. 1B.

As shown best in FIG. 3, the trigger group module 10 according to the invention may include an overtravel feature 41. Overtravel feature extends from a bottom wall 42 of housing 11 in a forward or front portion of the housing in position to contact a forward part of trigger component 15 so that the component cannot rotate further forwardly or clockwise in FIG. 3. This effectively defines the rearward most position of trigger 18. As is known in the art, overtravel control prevents the trigger from excessive rearward movement after the hammer release point.

The illustrated module 10 also includes a take-up feature 44. Take-up feature 44 extends from housing bottom wall 42 in a rear portion of housing 11 in position to contact a rear part of trigger component 15. Contact between take-up feature 44 and trigger component 15 prevents the trigger component from rotating further counterclockwise in FIG. 3, and thus the take-up feature effectively defines the forward most position of trigger 18. As is known in the art, take-up control minimizes the amount of trigger movement or "take-up" before reaching the hammer release point.

Both overtravel feature 41 and take-up feature 44 represent trigger component control features that define the limits of movement of the trigger component. In the preferred embodiment of the invention where housing 11 is formed from sheet metal, both features may be formed by pressing out a portion of the bottom wall of the housing using a suitable stamp or press. The illustrated overtravel and take-up features are stamped to form an elongated member that is unsupported at one end. These elongated members may be bent upward or downward to adjust the overtravel and take-up. Set screws or other adjustable arrangements in housing 11 may also be used to form adjustable overtravel and take-up features within the scope of the present invention. It will be appreciated, however, that the invention is not limited to modules including trigger component control features of any type.

The method of installing a trigger group in a firearm may be described with reference to FIGS. 4 through 8. The method includes inserting trigger group module 10 into a trigger group receiving area of a firearm receiver or frame 50. The trigger group receiving area in the illustrated firearm frame 50 is shown generally at reference numeral 51 (distinguishable only in FIG. 6) and comprises a cavity defined between lateral side walls 53 and 54 of firearm frame 50 large enough to house all of the trigger group components and allow each of the components to move as desired to perform their respective function. As mentioned previously, the model AR-15 rifle is used as a convenient and familiar example in this disclosure. In the AR-15 example, trigger group receiving area 51 is accessible through a top opening that is exposed by removing a top component of the firearm referred to as the upper receiver (52 in FIG. 5). Firearm frame 50 comprises the portion of the model AR-15 rifle known as the lower receiver and is shown in the figures with upper receiver 52 removed to expose the top opening to trigger group receiving area 51. Upper receiver 52 may be reattached to the lower receiver or frame 50 after trigger group module 10 is installed as described in detail below.

The OEM trigger group for the AR-15 model rifle includes the hammer, trigger component, disconnector, and associated springs similar to that shown in connection with module 10. In order to support the OEM trigger group components in the trigger group receiving area 51, firearm frame 50 includes a first pin receptacle for receiving and supporting a first pin and a second pin receptacle for receiving and supporting a second pin. In this case the first pin receptacle comprises a hammer pin receptacle made up of a right side receptacle opening 57 and a left side receptacle opening 58. The second pin receptacle comprises a trigger component receptacle made up of a right side receptacle opening 59 and a left side receptacle opening 60. Openings 57 and 59 are formed through the right lateral side wall 53, while openings 58 and 60 are formed through the left lateral side wall 54. Each of these openings 57, 58, 59 and 60 provide bearing surfaces for supporting, a respective pin extending through frame 50 between left lateral side wall 53 and right lateral side wall 54. The OEM pins are not shown in the figures, however, it will be appreciated that the pins fit into the respective pair of pin openings 57 and 58 or 59 and 60, and through the pin receiving opening of the respective trigger group component or components. The OEM hammer and trigger pins for the model AR-15 rifle each include an indent in a mid-section of the pin which cooperates with a part of the trigger group serving as a detent to hold the pin in place. In the installed position, the OEM trigger group pins support the hammer, trigger component, and disconnector in their respective operational positions and allow the components to pivot as desired according to the operation of the trigger group.

It will be appreciated that the trigger group receiving area of a firearm is a relatively small area, commonly less than two inches wide. Considering the small area in which to work, the small components that fit in the area, the close tolerances between components, and the spring loading of the components, it will also be appreciated that it is no easy matter to position the trigger group components in the trigger group receiving area of a firearm and hold the components in the proper position aligned with the pin receptacle openings while pressing the pins in place. This trigger group installation according to the prior art method generally requires special tools, skills, and experience.

Figure 4:
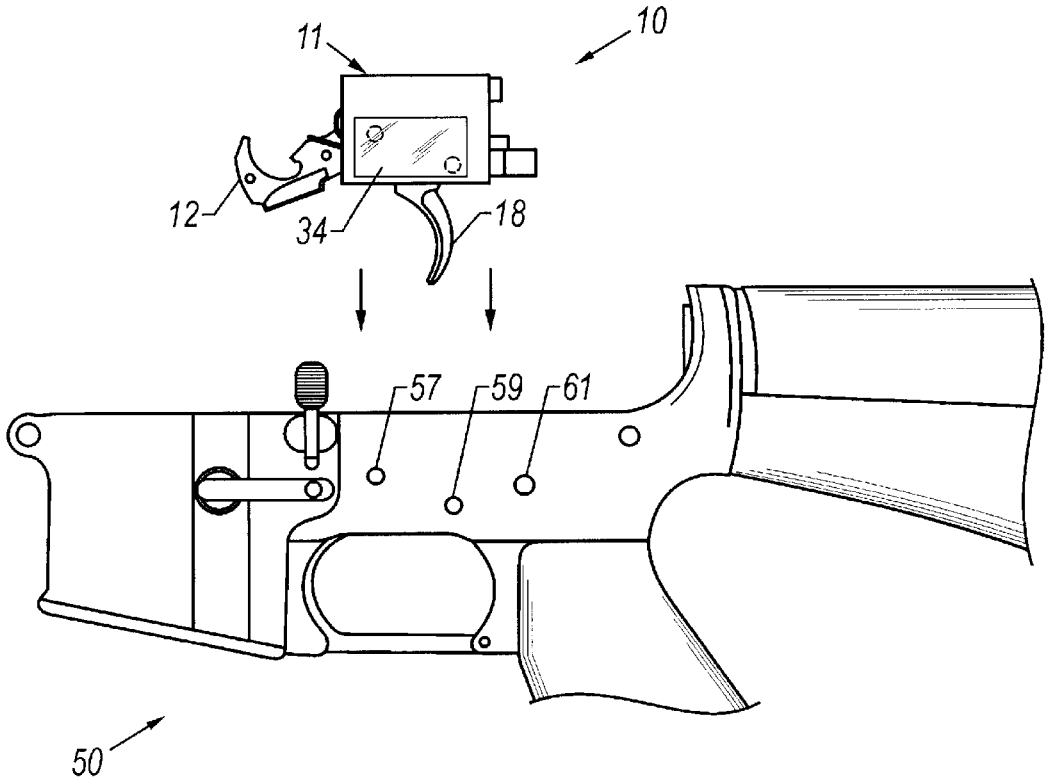
FIG. 4 is a side view showing a portion of a firearm with a trigger group module embodying the principles of the invention in position to be inserted to an operating position in the firearm.
Figure 5:
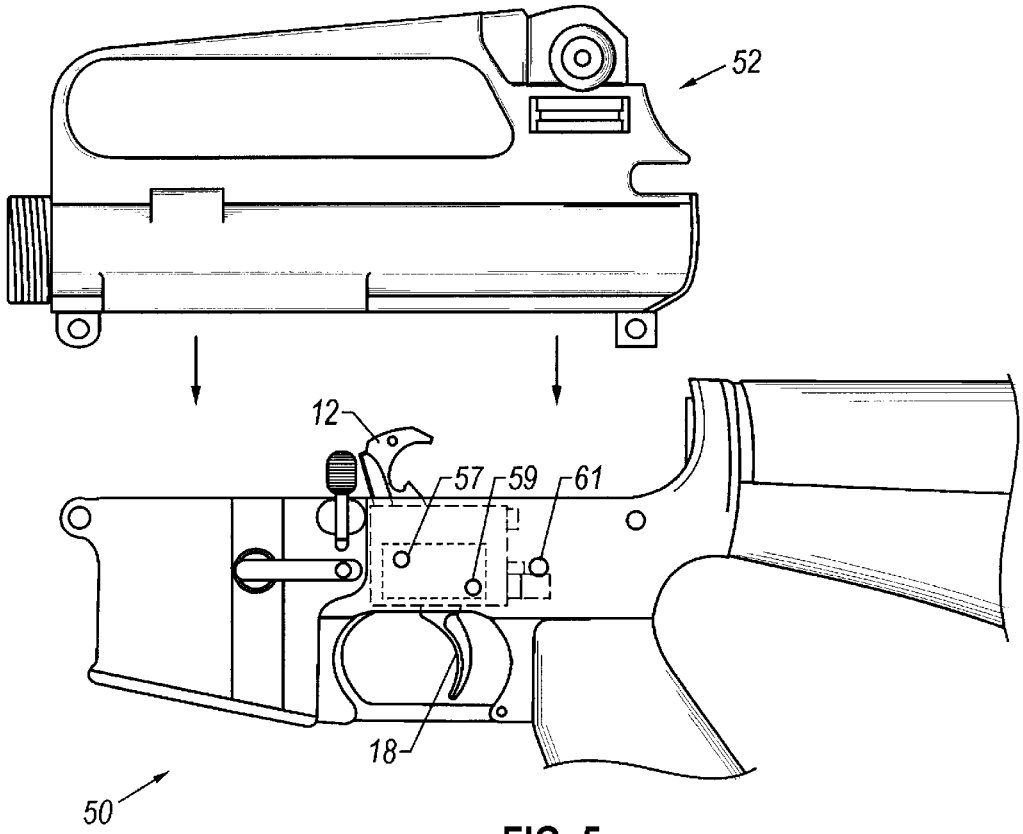
FIG. 5 is a side view similar to FIG. 4, but showing the trigger group module inserted to the operating position and showing an upper receiver in position to be connected over the trigger group module in the lower portion of the firearm.
Figure 6:
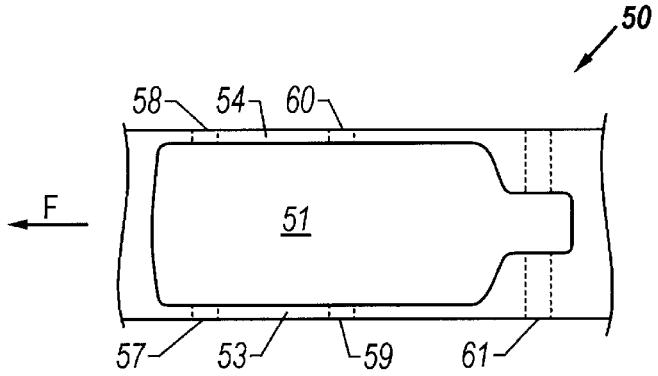
FIG. 6 is an enlarged top view of the trigger group receiving area of the firearm shown in FIGS. 4 and 5.

Trigger group installation according to the present invention using trigger group module 10 greatly simplifies installation, and may allow a new trigger group to be installed without special tools and skills. The present trigger group installation method includes first inserting the self-contained, pre-assembled trigger group module 10 into an operating position in firearm trigger group receiving area 51. To reach this operating position, at least one pin receiver on module housing 11 is aligned with a corresponding pin receptacle of the firearm. In the illustrated case, the first pin receiver is positioned with its defining openings 26 and 27 aligned with the firearm pin receptacle defined by receptacle openings 57 and 58. The illustrated case also requires positioning module housing 11 with the pin receiver openings 29 and 30 aligned with firearm pin receptacle openings 59 and 60. FIG. 4 shows pre-assembled trigger group module 10 positioned above the firearm and trigger group receiving area, while FIG. 5 shows the module and its housing 11 inserted to the operating position with the various openings aligned. It will be noted that inserting trigger group module 10 from the position shown in FIG. 4 to the position shown in FIG. 5 may be accomplished only after removing the safety mechanism from its receiving opening 61. It should also be noted that the temporary pins in this form of the invention, although long enough to be supported on module housing 11, are short enough to fit within the receiver opening 61.

Figure 7:
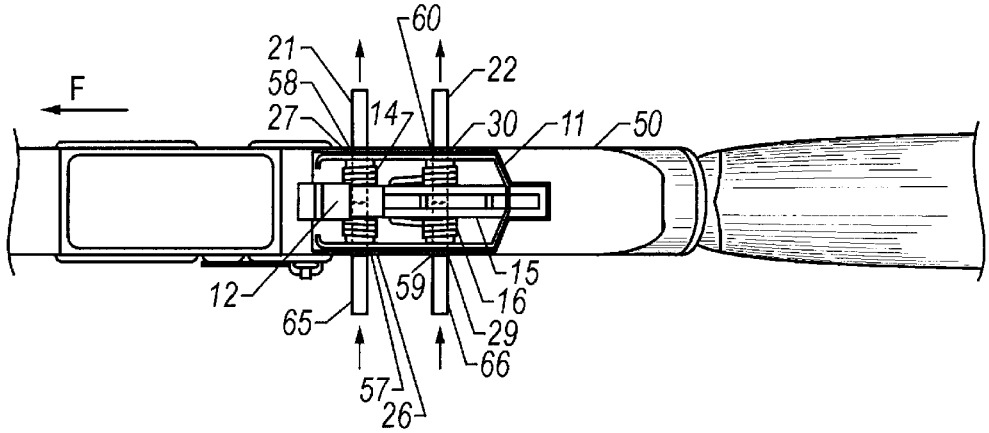
FIG. 7 is a top view of the firearm and trigger group module shown in FIG. 5, with permanent pins partially inserted.

After inserting module 10 to the operating position shown in FIG. 5 with the various pin openings aligned, the method then includes inserting a first permanent pin 65 through one of the first pin receptacle openings to displace first temporary pin 21. FIG. 7 shows first permanent pin 65, in this case comprising the trigger group hammer pin, inserted through first right side pin receptacle opening 57 and through first right side receiver opening 26 of housing 11. In the position shown in FIG. 7, first temporary pin 21, which had previously supported hammer 12 in module housing 11, is partially displaced out through the opposite side of the module and firearm, through pin receiver opening 27 and firearm pin receptacle opening 58.

The trigger group installation method according to the invention finally includes positioning first permanent pin 65 so that the pin is supported at one end by first right side pin receptacle opening 57 and is supported at its opposite end by first left side pin receptacle opening 58 on the opposite side of firearm frame 50. This final position of permanent pin 65 in shown in FIG. 8. It will be appreciated that the act of inserting permanent pin 65 to the position shown in FIG. 8 has completely displaced first temporary pin 21. Thus, first temporary pin 21 is not shown in FIG. 8.

In the embodiment of the invention shown in the figures, trigger group module 10 includes two temporary pins, first temporary pin 21 supporting hammer 12 and second temporary pin 22 supporting trigger component 15. Thus, once openings 29 and 30 making up the second pin receiver is aligned with openings 59 and 60 making up the second pin receptacle, the method includes inserting a second permanent pin 66 through one opening of the pin receptacle to displace second temporary pin 22 from module housing 11. FIG. 7 shows second permanent pin 66 inserted through the right side receptacle opening 59 and right side receiver opening 29, with second temporary pin 22 partially displaced through the openings 30 and 60 on the opposite side of the structure. Second permanent pin 66 is pushed further through openings 59 and 29 until it reaches the position shown in FIG. 8. In this position, permanent pin 66 is supported on one end by right side pin receptacle opening 59 and is supported at its opposite end by left side pin receptacle opening 60. As with first temporary pin 21, second temporary pin 22 has been completely displaced from housing 11 and firearm 50 and replaced by the respective permanent pin.

FIG. 7 shows both first temporary pin 21 and second temporary pin 22 being displaced from the module 10 simultaneously. This illustration is provided to show only how the two pins are displaced. In the preferred installation method according to the present invention, one of the temporary pins is fully displaced first, and then, with the one temporary pin fully displaced and the permanent pin installed, the installation method includes displacing the other temporary pin. The order in which the two temporary pins are displaced is generally not important to proper installation, and either one may be displaced first. Also, at least in the model AR-15 rifle example, the temporary pins may be displaced through either side of the firearm frame 50.

Figure 8:
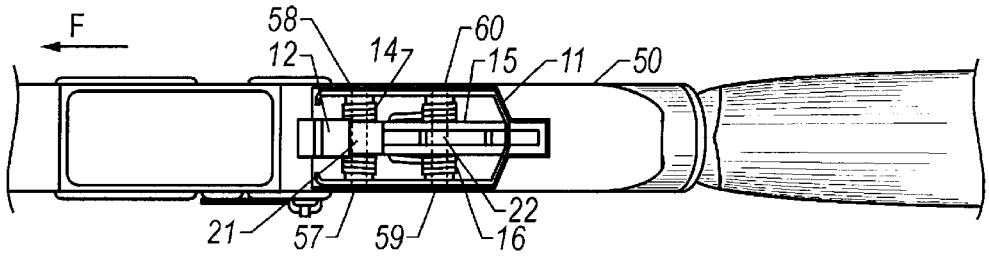
FIG. 8 is a top view similar to FIG. 7 but showing the permanent pins in the fully inserted position.

In the final installed position shown in FIG. 8, hammer 12 is supported from right and left side pin receptacle openings 57 and 58, respectively, that define the OEM hammer pin receptacle in firearm 50. Trigger component 15 and disconnector 17 are supported from the right and left side pin receptacle openings 59 and 60, respectively, that define the OEM trigger pin receptacle. Thus, hammer 12 is ultimately supported in the very same fashion that an OEM hammer is supported in firearm 50, and trigger component 15 and disconnector 17 are also supported in the very same fashion that the OEM trigger component and disconnector are supported. However, since hammer 12, trigger component 15, and disconnector 17, together with their respective springs are pre-assembled in housing 11, installing the trigger group components is simply a matter of dropping trigger group module 10 into trigger group receiving area 51 of firearm 50 and then pressing the permanent pins 65 and 66 in place.

In the preferred form of the invention shown in the drawings, temporary pins 21 and 22 are retained in place by the membrane 34 and 35 applied to both lateral sides 31 and 32 of housing 11 to cover openings 26, 27, 29, and 30 defining the two temporary pin receivers. The method of installing the trigger group thus also includes a step of releasing the temporary retainers. In the illustrated form of the invention, this releasing step comprises piercing the membranes 34 and 35 holding temporary pins 21 and 22 in place. That is, trigger group module 10 may be inserted to the operating position in firearm 50 with the membranes 34 and 35 remaining attached to lateral housing walls 31 and 32. The step of inserting the permanent pins 65 and 66 thus pierces both membranes. One membrane is pierced directly by the end of the permanent pin being inserted, while the membrane on the other side of housing 11 is pierced by the temporary pin being displaced from the housing.

In other forms of the invention the step of releasing the temporary pin retainers may include removing membranes 34 and 35 prior to inserting module 10 to the operating position. Other temporary pin retainer devices within the scope of the invention may be removed in other ways. For example, module 10 may be distributed with one or more clips positioned on housing 11 so as to cover or partially cover the pin receiver openings 26, 27, 29, and 30. The clip or clips would be in lieu of the tape or membrane segments 34 and 35 shown in the present figures. Releasing this type of retainer arrangement would comprise removing the clip or clips prior to inserting module 10 to the operating position. Yet other forms of the invention may require no additional retention device for retaining temporary pins 21 and 22 in place prior to insertion of the permanent pins. However, additional retainers for the temporary pins may be required or at least helpful in holding the temporary pins in place as module 10 is shipped and handled.

The installation method illustrated in FIGS. 7 and 8 assumes the trigger group module 10 is of the form employing temporary pins which are replaced by permanent pins. However, other trigger group modules within the scope of the present invention may include permanent trigger group pins rather than temporary pins. That is, the pins 21 and 22 which are described above as "temporary" pins, may in fact be permanent and may remain in the module to support the trigger group components during operation. In these forms of the invention pins 21 and 22 may be held in place in module housing 11 by frictional engagement with the receiver openings, by "C" retainers, or by any other suitable means.

In embodiments of the module 10 in which pins 21 and 22 are not replaced by other pins in operation, the pins may or may not align with the OEM pin receptacles of the firearm frame. Because the pins in the module 10 need not align with the OEM pin receptacles in some forms of the invention, those modules may include a completely different trigger group geometry and structure from the one originally designed for the firearm. Regardless of whether pins 21 and 22 align with the OEM pin receptacles, the OEM pin receptacles may still be used in retaining the trigger group module 10 in the operating position in the firearm frame 50. For example, pins, screws, or other elements may be mounted in or through OEM pin receptacles and contact the module 10 or some feature on the module to retain the module in the desired operating position. The OEM pin receptacles may need to be modified to provide the desired function. For example, threads may be tapped into the OEM pin receptacles to accept a retainer or set screw.

It should also be noted that in the model AR-15 rifle example described above, the OEM pin receptacles are designed by the original manufacturer to support trigger group components that are not pre-assembled in a module according to the present invention. However, trigger group modules within the scope of the invention are not limited to use in firearms originally designed to be used with trigger group components assembled in place in the firearm. Rather, trigger group modules within the scope of the present invention may be used with firearms specifically designed to use the trigger group module. An OEM pin receptacle may be a receptacle designed to cooperate with a trigger group module according to the invention.

The above described preferred embodiments are intended to illustrate the principles of the invention, but not to limit the scope of the invention. Various other embodiments and modifications to these preferred embodiments may be made by those skilled in the art without to departing from the scope of the following claims.

What is claimed is:

1. A trigger group module for a firearm, the firearm including a portion defining a trigger group receiving area for containing one or more trigger group components, the trigger group module including:

(a) a module housing adapted to be inserted to an operating position in the trigger group receiving area;

(b) a first pin receiver positioned in the module housing so as to align with first pin receptacle openings of the firearm when the module housing is in the operating position, the first pin receptacle openings defining pin support surfaces formed in the portion of the firearm defining the trigger group receiving area;

(c) a first module pin received in the first pin receiver;

(d) a pivoting trigger group component mounted on the module housing for rotation about the first module pin;

(e) a right membrane positioned on an outer surface of the housing so as to fully or partially cover a first side of the first pin receiver; and (f) a left membrane positioned on an outer surface of the housing so as to fully or partially cover a second side of the first pin receiver.

2. The trigger group module of claim 1 further including:

(a) a second pin receiver positioned in the module housing so as to align with second pin receptacle openings of the firearm when the module housing is in the operating position, the second pin receptacle openings defining pin support surfaces formed in the portion of the firearm defining the trigger group receiving area;

(b) a second module pin received in the second pin receiver;

(c) a second pivoting trigger group component mounted on the module housing for rotation about the second module pin; and (d) wherein the right membrane fully or partially covers a first side of the second pin receiver and the left membrane fully or partially covers a second side of the second pin receiver.

3. A trigger group module for a firearm, the trigger group module including:

(a) a module housing adapted to be inserted to an operating position in a firearm;

(b) a first pin receiver positioned in the module housing;

(c) a first temporary pin supported on the module housing in a first component supporting position, the first temporary pin having a first end supported at a first side of the first pin receiver and a second end supported at a second side of the first pin receiver; and (d) a right side membrane adhered to an outer surface of the module housing so as to fully or partially cover the first side of the pin receiver and a left side membrane adhered to an outer surface of the module housing so as to fully or partially cover the second side of the pin receiver.

4. The trigger group module of claim 3 further including:

(a) a second pin receiver in the module housing;

(b) a second temporary pin supported on the module housing in a second component supporting position, the second temporary pin having a first end supported at the first side of the second pin receiver and a second end supported at the second side of the second pin receiver;

(c) a second temporary pin retainer positioned to retain the second temporary pin in the second component supporting position;

(d) a hammer supported on the first temporary pin; and (e) a trigger component supported on the second temporary pin.

5. The trigger group module of claim 4 wherein the second temporary pin retainer comprises a rearward portion of the right side membrane adhered to an outer surface of the module housing so as to fully or partially cover the first side of the second pin receiver and a rearward portion of the left side membrane adhered to an outer surface of the module housing so as to fully or partially cover the second side of the second pin receiver.

6. A method of installing a trigger group in a firearm, the method including the steps of:

(a) inserting a trigger group module into a trigger group receiving area of a firearm;

(b) aligning a first temporary pin supported on the module with a first pin receptacle of the firearm;

(c) inserting a first permanent pin through one side of the first pin receptacle to displace the temporary pin from the trigger group module; and (d) positioning the first permanent pin in the first pin receptacle so that the first permanent pin is supported at a first end thereof by a first bearing surface of the first pin receptacle and is supported at a second end thereof by a second bearing surface of the first pin receptacle.

7. The method of claim 6 further including the steps of:

(a) aligning a second temporary pin supported on the module with a second pin receptacle of the firearm;

(b) inserting a second permanent pinthrough one side of the second pin receptacle to displace the second temporary pin from the trigger group module; and (c) positioning the second permanent pin in the second pin receptacle so that the second permanent pin is supported at a first end thereof by a first bearing surface of the second pin receptacle and is supported at a second end thereof by a second bearing surface of the second pin receptacle.

8. The method of claim 6 further including the step of releasing a temporary holding arrangement holding the first temporary pin in the trigger group module.

9. The method of claim 8 wherein the step of releasing the temporary holding arrangement comprises piercing a membrane adhered to a trigger group module surface.

10. A method of installing a trigger group in a firearm, the method including the steps of:

(a) inserting a trigger group module into a trigger group receiving area of a firearm;

(b) aligning a first pin receiver on the trigger group module with a hammer pin receptacle of the firearm;

(c) supporting a hammer component of the trigger group module from bearing surfaces of the hammer pin receptacle by inserting a first permanent pin through one side of the hammer pin receptacle to displace a temporary hammer pin from the trigger group module;

(d) aligning a second pin receiver on the trigger group module with a trigger pin receptacle of the firearm; and (e) supporting a trigger component of the trigger group module from bearing surfaces of the trigger pin receptacle by inserting a second permanent pin through one side of the trigger pin receptacle to displace a temporary trigger pin from the trigger group module.

11. A trigger group module for a firearm, the firearm including a portion defining a trigger group receiving area for containing one or more trigger group components, the trigger group module including:

(a) a module housing adapted to be inserted to an operating position in the trigger group receiving area;

(b) a first pin receiver positioned in the module housing so as to align with first pin receptacle openings of the firearm when the module housing is in the operating position, the first pin receptacle openings defining pin support surfaces formed in the portion of the firearm defining the trigger group receiving area;

(c) a first module pin received in the first pin receiver;

(d) a pivoting trigger group component mounted on the module housing for rotation about the first module pin;

(e) an overtravel feature extending from an upper surface of a bottom wall of the module housing in a forward part of the module housing; and (f) a take-up feature extending from an upper surface of the bottom wall of the module housing in a rear part of the module housing.

* * * * *

UNITED STATES PATENT AND TRADEMARK OFFICE

CERTIFICATE OF CORRECTION

PATENT NO. : 6,722,072 B1
DATED : April 20, 2004
INVENTOR(S) : Michael L. McCormick It is certified that error appears in the above-identified patent and that said Letters Patent is hereby corrected as shown below:

Column 1,
Line 67, change “finctioning” to -- functioning --

Column 6,
Line 57, change “supporting,” to -- supporting --
Line 66, change “without to departing” to -- without departing --

Column 11,
Line 31, change “pinthrough” to -- pin through --

Signed and Sealed this

Thirtieth Day of November, 2004

JON W. DUDAS
*Director of the United States Patent and Trademark Office*